United States Patent [19]

Hanyu et al.

[11] 4,340,002

[45] Jul. 20, 1982

[54] UPPER SHAFT PHASE DETECTING SYSTEM FOR SEWING MACHINES

[75] Inventors: Susumu Hanyu; Hideaki Takenoya, both of Hachioji, Japan

[73] Assignee: Janome Sewing Machine Co. Ltd., Tokyo, Japan

[21] Appl. No.: 182,317

[22] Filed: Aug. 28, 1980

[30] Foreign Application Priority Data

Jun. 9, 1979 [JP] Japan ..... 54/113498

[51] Int. Cl.[3] ..... D05B 3/02

[52] U.S. Cl. ..... 112/158 E

[58] Field of Search ..... 112/158 E, 121.11, 121.12, 112/220, 221, 277

[56] References Cited

U.S. PATENT DOCUMENTS 4,131,075 12/1978 Wurst ..... 112/158 E
4,159,002 6/1979 Minalga ..... 112/158 E
4,231,307 11/1980 Takenoya ..... 112/158 E

*Primary Examiner*—Peter P. Nerbun
*Attorney, Agent, or Firm*—Michael J. Striker

[57] ABSTRACT

An upper shaft phase detecting system in which the rotation speed of the upper shaft is sensed and utilized to vary the time at which data starts to be released from an electronic memory of a sewing machine.

1 Claim, 7 Drawing Figures

FIG. 7

| Address | Data |
|---|---|
| 0 0 0 0 0 | 1 1 1 1 1 |
| 0 0 0 0 1 | 1 1 1 1 1 |
| 0 0 0 1 0 | 1 1 1 1 1 |
| 0 0 0 1 1 | 1 1 1 1 1 |
| 0 0 1 0 0 | 1 1 1 1 1 |
| 0 0 1 0 1 | 1 1 1 1 0 |
| 0 0 1 1 0 | 1 1 1 0 1 |
| 0 0 1 1 1 | 1 1 1 0 0 |
| 0 1 0 0 0 | 1 1 0 1 1 |
| | |
| 1 1 0 1 0 | 0 0 0 1 0 |
| 1 1 0 1 1 | 0 0 0 0 1 |
| 1 1 1 0 0 | 0 0 0 0 1 |
| 1 1 1 0 1 | 0 0 0 0 0 |
| 1 1 1 1 0 | 0 0 0 0 0 |
| 1 1 1 1 1 | 0 0 0 0 0 |

UPPER SHAFT PHASE DETECTING SYSTEM FOR SEWING MACHINES

BRIEF DESCRIPTION OF THE INVENTION

The invention relates to a sewing machine having an electronic memory storing stitch control data which are sequentially read out per rotation of the upper shaft of the sewing machine to operate the actuators controlling the needle and the feed dog respectively, thereby to produce the pattern of stitches. More particularly, the invention relates to an upper shaft phase detecting system for such a sewing machine in which the detecting time of the upper shaft rotation phase is varied in dependence upon the rotation speed of the sewing machine so as to reduce the limitation to the maximum rotation speed of the sewing machine.

It is generally known that the actuator controlling the needle or the feed dog delays in response electrically and mechanically to a detecting signal of the upper shaft rotation phase. The upper shaft rotation phase detector usually consists of a light source and a phototransistor, and a rotational plate mounted on the upper shaft and rotated therewith. The phototransistor produces a pulse signal each time when the plate interrupts or releases the light to the phototransistor. The phototransistor receives the light and produces a pulse signal which is applied to a control circuit to read out a set of stitch data from the electronic memory to operate the actuators controlling the needle swinging movement and the fabric feeding movement. In this case, the actuators lag in response to the pulse signal due to the inductance and the mechanical inertia of the actuators and the associated elements. The lagging time from the detection of the upper shaft rotation phase to the actuation of the needle and feeding mechanism is produced irrespectively of the rotation speed of the upper shaft. Actually the operation time of the needle swing control mechanism or the feed control mechanism is considerably varied in a low rotation speed operation and a high rotation speed operation of the sewing machine.

To explain this, FIG. 1 shows a signal respondency of the actuator and the associated elements by way of example, in which time is taken laterally and the needle swinging movement is taken vertically by way of example. If a control signal (rotation amount designating signal of actuator controlling the needle) is given as shown in the solid line in the period of time (T) to shift the needle from the position ($A_1$) to the position ($A_2$), the needle is actually shifted to the designated position with a lagging time ($T_1$) and the shifting movement is finished in the time ($T_2$). FIG. 2 shows a needle plate (P) and the movement of the needle point in relation to the laterally shown rotation angles of the upper shaft (one rotation 360°). The selection of a pattern and the manual adjustment of stitches are received, for example, in a designation receiving region ($\theta°$) which requires the needle point to be in a predetermined position above the needle plate (P) at the ends (a, b), and a height (H) from the needle plate is selected so as to be able to broaden the designation receiving region ($\theta°$).

As the sewing machine is rotated, the needle swing control signal is produced at the point (a) where the needle point is located while it is moved up. Actually the control signal actuates the needle swing control mechanism at the point ($a_1$) due to the lagging time ($T_1$) in FIG. 1, especially when the sewing machine is rotated at a high speed. This means that the needle swing control mechanism is required to complete the operation in a shorter period of time ($a_1$)−(b), namely in a smaller rotation angle ($\theta°_1$) of the upper shaft, while the needle swing control mechanism is allowed to complete the operation in a substantially longer period of time (a)−(b), namely in a bigger rotation angle ($\theta°$) of the upper shaft when the sewing machine is rotated at a low speed. To explain this in relation to the limitation or hindrance to the maximum rotation speed of the sewing machine: if the time $T_2$ (second) is required to complete the maximum operation distance of the needle swing control mechanism in one rotation of the upper shaft, the maximum rotation speed (rotation number) N per minute is $$(\theta°_1/360°)\times(60/T_2).$$

This means that the rotation angle ($\theta°_1$) becomes smaller as the rotation speed of the upper shaft increases, and thus the maximum rotation number N is limited. Moreover, the reduction of the rotation angle ($\theta°_1$) limits the maximum rotation speed of the upper shaft regarding the object to reduce the noise and vibration of the sewing machine by reducing the speed of the control actuators as much as possible so as to lengthen the time ($T_2$).

The present invention has been provided to eliminate such defects and disadvantages of the prior art.

It is a primary object of the invention to vary the time of data release in relation to the upper shaft rotation phase of a sewing machine in dependence upon the rotation speeds of the sewing machine, thereby to reduce the limitation or hindrance to the maximum speed operation of the sewing machine.

It is another object of the invention to provide a sewing machine producing proper stitches irrespectively of the rotation speed of the sewing machine.

The other features and advantages of the invention will be apparent from the description of the preferred embodiment.

DETAILED DESCRIPTION OF THE DRAWINGS

Figure 1:
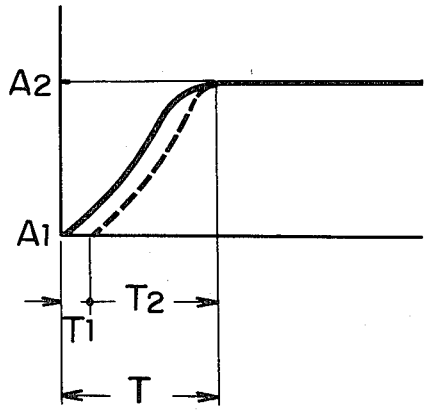
Figure 2:
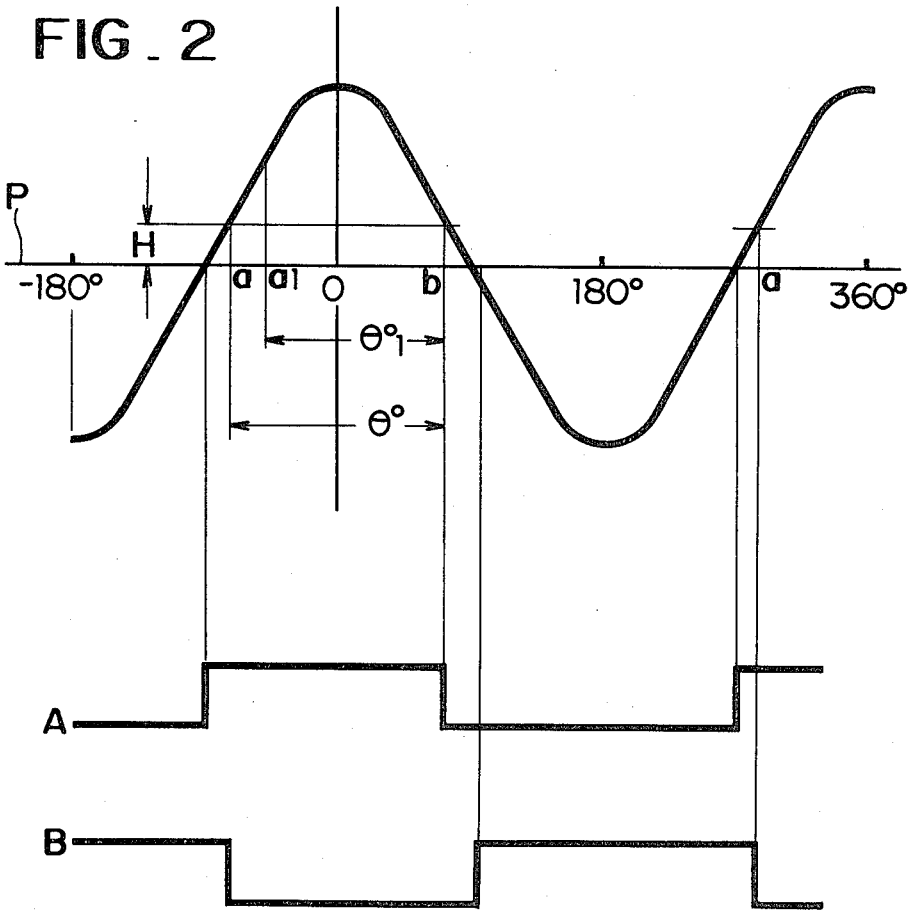
Figure 3:
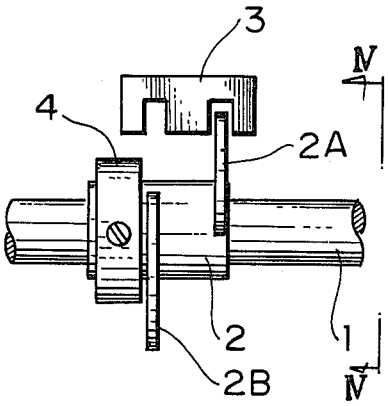
Figure 4:
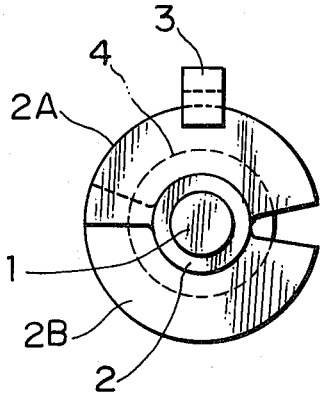
Figure 5:
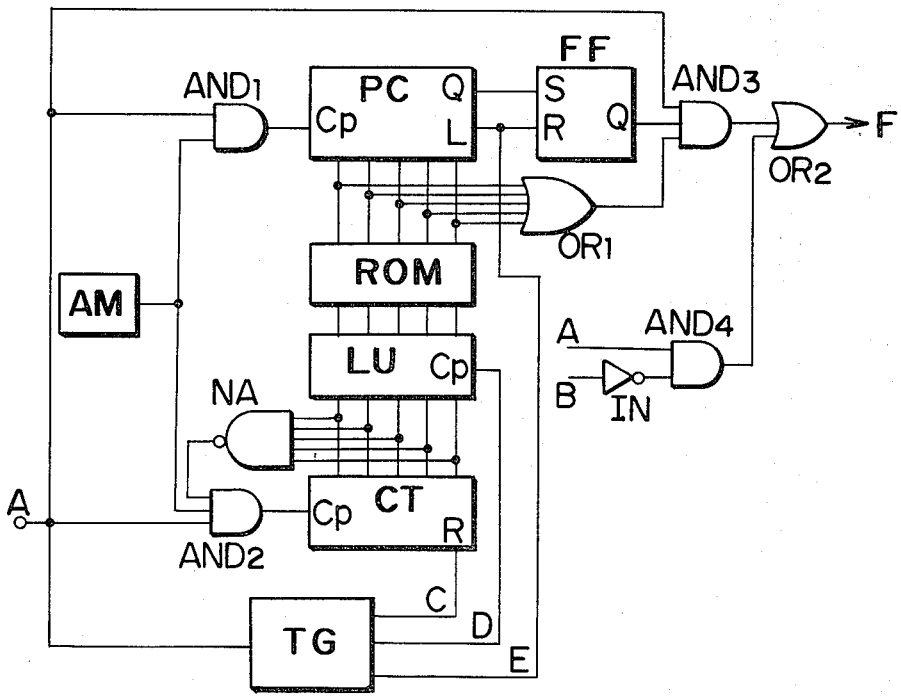
Figure 6:
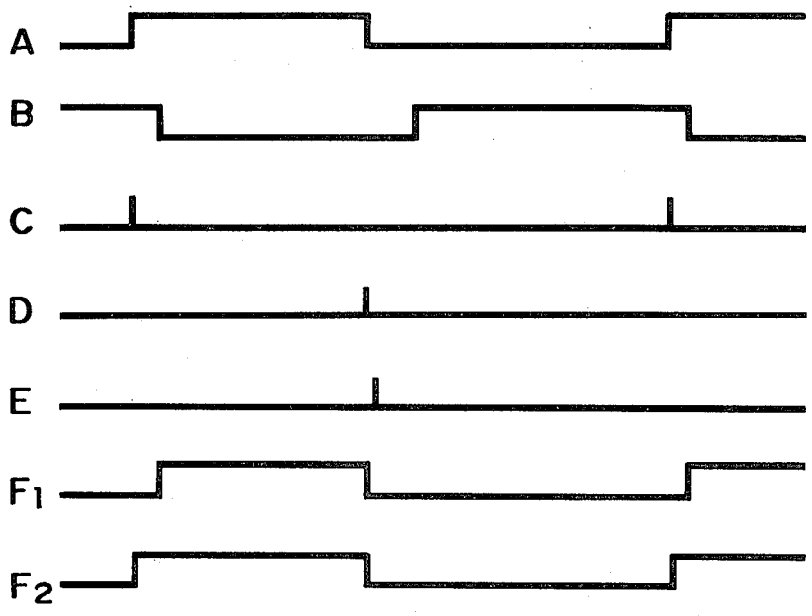

FIG. 1 shows an explanatory view of a signal respondency of the stitch control actuators, FIG. 2 shows an explanatory view of a relation between the vertical movement locus of the needle point, the rotation of the upper shaft and the rotation phase detection of the upper shaft, FIG. 3 shows a front elevational view of a rotation phase detector of the upper shaft in accordance to the invention, FIG. 4 shows a side elevational view of the rotation phase detector taken the line IV, FIG. 5 shows a control circuit diagram of the invention, FIG. 6 shows the operation signal diagrams of the respective parts of the control circuit diagram, and FIG. 7 shows the data table of a memory.

DETAILED DESCRIPTION OF THE INVENTION

The present invention will be explained in reference to the attaching drawings. The invention is to compensate the operational interval $\theta_1°$ of the control mechanism which decreases as the rotation speed of the sewing machine becomes higher, thereby to enlarge the operational range as much as possible at the high speed of the sewing machine. A reference will be made to details thereof. FIGS. 3 and 4 show an upper shaft 1 of the sewing machine rotated in the clockwise direction in FIG. 4, and a rotation phase detector composed of a base 2 secured to the upper shaft 1 by a fastening ring 4, a sector plate 2A secured to the base 2 for detecting the upper position of the needle, another sector plate 2B secured to the base 2 for detecting the lower position of the needle, and a level signal generator 3 secured to the machine housing (not shown). The level signal generator 3 is provided with a light source and a phototransistor (not shown) with respect to the sector plates 2A, 2B respectively as generally known. The sector plates 2A, 2B are rotated with the upper shaft 1 to alternately interrupt and release the light with respect to the phototransistor. While the sector plate 2A releases the light, the phototransistor receives the light and produces a signal of a high level as shown at A in FIG. 2 where the needle point gets out from an upper surface P of the needle plate and reaches a phase (b). On the other hand, while the sector plate 2B releases the light, the phototransistor produces a signal of a high level as shown at B in FIG. 2 where the needle point gets to below the surface P and reaches a phase (a). With respect to a couple of signals A and B in FIG. 2, if the high level is 1 and the low level is 0, one reciprocation of the needle is divided from a starting point (a) into four (1, 1), (1, 0), (0, 0) and (0, 1). FIG. 5 shows a control circuit diagram of the phase detection concerning the lateral swinging movement of the needle. The signal A in FIG. 2 is given to the input of a timing generator TG as well as to one of the input of AND circuit AND1 and to one of the inputs of AND circuit AND2. The timing generator generates pulses C, D, E in FIG. 6 at the output terminals (C), (D), (E) thereof upon receiving the signal A.

FIG. 6 again shows the signals A and B of FIG. 2, where pulse signals C and D are generated at the rising point and the falling point of the signal A respectively, and the pulse signal E is generated at a point a little lagging from the signal D. These signals C, D, E are respectively given to the reset terminal R of a counter CT, to the trigger terminal Cp of a latch circuit LU, to the load terminal L of a presetable counter PC and to the reset terminal R of a flip-flop circuit FF. AM is an astable multivibrator which produces pulses independently of the rotation of the sewing machine with a frequency dividing one reciprocation of the needle into about 128 at the highest possible high rotation of the sewing machine, and is connected to the other inputs of AND circuits $AND_1$, $AND_2$ respectively. The counter CT is a binary counter which is reset when the control power source is supplied and when the terminal R receives a signal, and receives the output of the AND circuit AND2 at the trigger terminal Cp to count each of the outputs of 5 bits from 0 0 0 0 0 to 1 1 1 1 1 in one unit of 16 pulses, and the output is applied to the so many inputs of the latch circuit LU and to the inputs of NAND circuit NA. The output of the NAND circuit NA is connected to the third input of AND circuit AND2 to stop the counting operation of the counter CT when the output of the counter CT is 1 1 1 1 1. When the latch circuit LU receives a signal at the trigger terminal Cp to latch the output signal of the counter CT and supplies it as an address signal of a read-only-memory ROM. The output signal of the memory is supplied to the inputs of the presetable counter PC. This counter PC is reset to 0 0 0 0 0 when the control power source is supplied, and when the load terminal L receives a signal, the data of ROM is loaded. The counter PC increases the count each time it receives the output of the AND circuit AND1 at the trigger terminal Cp. When the counter counts 1 1 1 1 1, the output Q thereof is rendered 1 which is supplied to the set terminal S of the flip-flop circuit FF. When the control power source is supplied, the stored data of ROM is reset to 0 0 0 0 0. As shown in FIG. 7 the memory ROM is provided with the addresses from the minimum binary number 0 0 0 0 0 to the maximum binary number 1 1 1 1 1, and the corresponding data, some of which are progressively decreased, some of which are unchanged in groups, and the groups themselves are decreased as the addresses are increased. As shown, there are arranged many unchanged data around the minimum and maximum addresses, while the data are progressively decreased around the medium addresses in accordance to the necessity of the control. AND circuit AND3 receives the signal A as a first input thereof, and receives the output signal Q of the flip-flop circuit FF as a second input, and receives as a third input the output of OR circuit OR1 which receives the output of ROM. OR circuit OR2 receives the output of AND circuit AND3 at its one input and receives at the other input the output of AND circuit AND4 which receives the signal A and an inverted signal of the signal B via an inverter IN. OR circuit OR2 issues a signal concerning the time point (a) where a needle swing control signal is produced to change the distance between a delayed position at which the signal $F_1$ rises in a low speed rotation of the sewing machine and an early position at which the signal $F_2$ rises in a high speed rotation of the sewing machine.

The control operation of the needle lateral movement will be referred to in the above mentioned structure. If the control power source is supplied when the needle upper position detecting plate 2A interrupts the light, for example, as shown in FIG. 4, the needle upper position detecting signal A of the level signal generator is of a low level, and the needle point shown by the curve line in FIG. 1 is located at a position lower than the height H above the needle plate P or at a position below the needle plate P, and the needle swing control is not made in this region. If the upper shaft 1 is at the angular position rotated 180° from a position, e.g., in FIG. 4, the sector plate 2A releases the light to the phototransistor, and the needle upper position detecting signal A is of a high level, and the needle point is within the interval $\theta°$ where the needle point is located at a position higher than the height H from the needle plate P. Since the sewing machine is stopped, the counter CT counts the number until it becomes 1 1 1 1 1 due to the signal of the astable multivibrator AM. However, the counted data is not latched because the timing generator TG does not generate the pulse signal D. Therefore, ROM remains with the reset value 0 0 0 0 0 when the control electric power source is supplied. On the other hand, the presetable counter PC is reset when the power source is applied, and then starts to count by the signal of oscillator AM. When the counter counts up 1 1 1 1 1, the flip-flop circuit FF is set and the output becomes 1 the input to AND circuit AND3. Since the output of OR circuit OR1 is 0, the output of the AND circuit is 0. Therefore, the output F of OR circuit OR2 is 1 at the time when AND circuit AND4 is 1 receiving the signal A and the inverted signal B, namely when the needle point is located at a position past the point (a) in FIG. 2.

The output signal F of the OR2 is shown as F1 in FIG. 6, and its rising point is of the latest phase in the instant control. It is a matter of course that said rising point coincides with the power source supplying time.

When the sewing machine starts the rotation, the signal D of the timing generator TG latches the data 1 1 1 1 1 of the counter CT to the latch circuit LU. The data of ROM is then 0 0 0 0 0 in FIG. 7 and this data is loaded to the presetable counter PC by the signal E of the timing generator TG, and the counter counts up after the subsequent rising of the signal A and sets the flip-flop circuit FF similarly as in the case when the sewing machine is standstill. Since the output of OR circuit OR1 is 0, the signal F is determined only by the signal of AND circuit AND3 similarly in the case when the sewing machine is standstill, and the signal F becomes the signal F1 in FIG. 6. This means that the signal F becomes the signal $F_1$ when the data of ROM is 0 0 0 0 0 in the subsequent rotation of the sewing machine (this is at the low speed rotation of the sewing machine). Therefore, in a low speed rotation of the sewing machine, the signal detecting point (a) is not moved, and each time when the signal is detected at the point (a), the data is read out from a memory (not shown) for controlling stitches to drive an actuator or a control motor (not shown) at a little delayed phase, and the needle lateral amplitude is controlled at an initial point of the interval $\theta°$.

A next reference will be made to a higher rotation of the sewing machine. Table in FIG. 7 shows that the uppermost column is addressed for the maximum speed rotation, and the lowest column is addressed for the minimum speed rotation, and the other columns therebetween are addressed for the variable speed rotations. Since the counter CT starts to count at the rising point of the signal C and latches the value thereof to the latch circuit LU at the rising point of the signal D to render it as an address signal, the counted value becomes larger as the time is longer than the signal A is 1 and accordingly a lower address is designated. In the table, the address 0 0 0 0 0 corresponds to the maximum possible speed of the sewing machine. When the sewing machine comes to such a maximum possible speed, namely when the signal C is generated and the oscillator AM generates the pulses of $16\times5$, and then the signal D is generated, the latch circuit LU becomes of the data 0 0 1 0 1 which becomes the address of the memory ROM. Then the memory ROM gives the data 1 1 1 1 0 to the presetable counter PC, and this data is loaded there by the signal E. Then the counter PC counts up the trigger signal Cp by the next signal C, and the data becomes 1 1 1 1 1 at the first counting to set the flip-flop circuit FF. Since AND circuit AND3 receives 1 of the signal A and 1 of OR circuit OR1, the output is 1. The signal F, therefore, rises delayed a little than the signal C as shown by F2 in FIG. 6 and the rising point is shifted to the left from that of the signal F1. While the sewing machine is driven at the maximum speed rotation, the data of ROM is 1 1 1 1 1, and since the presetable counter PC sets the flip-flop circuit by the signal C, the rising point of the signal F coincides with that of the signal C. In this case, the counter CT counts four and designates, as mentioned above the address 0 0 1 0 0, while the oscillator AM counts $16\times4=64$. For obtaining such a number of oscillations, the oscillator is set to issue about 128 pulses during one reciprocation of the needle at the maximum speed rotation. Since the low speed region may be the same with the case when the sewing machine is standstill, the data is 0 0 0 0 0.

A further reference will be made to the fabric feed control. The control circuit is composed of another circuit of the same principle with that of FIG. 5, in which the signal A is replaced by the signal B, and the signal B is replaced by the signal A, and a first input of AND circuit AND3 is so connected to the AND circuit through an inverter. The memory ROM stores proper feed control data, so that the rising point of the detected signal may coincide with the rising point of the signal B in accordance with the signal F at a low speed rotation of the sewing machine, and the detected signal may be shifted to the left side in FIG. 6 at a high speed rotation of the sewing machine.

Thus, in reference to FIG. 2, if the signal detecting point (a) is shifted to the left at said high speed rotation of the sewing machine, the needle point is then located at a position lower than the height H from the needle plate P, and at this point the needle swing control signal is read out and given to a stitch control circuit (not shown). This control circuit gives this signal to a needle swing control motor as a driving signal. And though the response of the control motor will be delayed electrically and mechanically as shown in FIG. 1, the actuation starting point of the motor will come approximately to the phase where the needle point is at the height H from the needle plate P as shown in FIG. 2. Thus the delayed actuation of the needle or feed control motor and the associated mechanism is compensated especially at a high speed rotation of the sewing machine.

In fact, the delayed time of the control motor is 2/1000 second, and the time required to control the maximum swinging distance of the needle is 20/1000 second. Therefore, the total is 22/1000 second. Since $\theta°$ is around 170°, the maximum possible rotation number N (per minute) is, if the control is not carried out, $N=(170/360)\cdot(60/0.022)\approx1300$. If the delayed time T1 is compensated by the invention, $N=(170/360)\times(60/0.02)\approx1400$, and the maximum rotation number may be increased.

I claim:

1. An upper shaft phase detecting system for a sewing machine having an electronic memory storing stitch control signals which are sequentially read out per rotation of the upper shaft of the sewing machine to control the stitch forming instrumentalities of the sewing machine, comprising means operated in synchronism with the upper shaft to detect the rotation phases of the upper shaft in four divisions, means (AM, CT) for detecting the rotation speed of the upper shaft, and means (ROM, PC) operated in association with the rotation speed of the upper shaft to shift the rotation phase divisions of the upper shaft so as to control the operation of the stitch forming instrumentalities.

* * * * *